United States Patent [19]

Nakamura et al.

[11] Patent Number: 4,872,829

[45] Date of Patent: Oct. 10, 1989

[54] FIRE-EXTINGUISHING DEVICE FOR OIL BURNER

[75] Inventors: Kazuharu Nakamura, Nagoya; Yoshio Mito, Gifu; Yutaka Nakanishi, Kounan; Toshihiko Yamada, Anjou; Kenji Nakamura; Kiyonobu Itoh, both of Aichi, all of Japan

[73] Assignee: Toyotomi Kogyo Co., Ltd., Aichi, Japan

[21] Appl. No.: 306,183

[22] Filed: Feb. 6, 1989

Related U.S. Application Data

[62] Division of Ser. No. 834,597, Feb. 28, 1986, Pat. No. 4,810,185.

[30] Foreign Application Priority Data

Mar. 1, 1985 [JP] Japan ..... 60-41612

[51] Int. Cl.[4] ..... F23N 5/24

[52] U.S. Cl. ..... 431/33; 431/150; 126/96

[58] Field of Search ..... 126/96; 431/200, 201, 431/150, 144, 29, 344, 331, 146, 33, 148

[56] References Cited

U.S. PATENT DOCUMENTS 564,992 8/1896 Gregory .
2,646,789 7/1953 Lampert .
3,381,678 5/1968 Fry .
4,285,666 8/1981 Burton et al. .
4,427,365 1/1984 Kotera et al. .
4,498,862 2/1985 Nakamura et al. .

FOREIGN PATENT DOCUMENTS 28916 8/1981 Japan .
10681 of 1896 United Kingdom .
1370467 10/1974 United Kingdom .

*Primary Examiner*—Randall L. Green
*Attorney, Agent, or Firm*—Pollock, Vande Sande & Priddy

[57] ABSTRACT

A fire-extinguishing device for an open-type oil burner is disclosed which is capable of effectively preventing the discharge of bad odor to a room due to unburned fuel oil gas at the fire-extinguishing of the oil burner. The fire-extinguishing device includes a damper for closing, at the fire-extinguishing, an opening of a combustion cylinder construction of the oil burner through which combustion gas is discharge to a room. The damper or combustion cylinder construction may be provided with an oxidation catalyst plate through which combustion gas is discharged to a room at the fire-extinguishing, so that unburned fuel oil gas may be removed by means of the catalyst plate.

16 Claims, 4 Drawing Sheets

FIRE-EXTINGUISHING DEVICE FOR OIL BURNER

This is a continuation, of application Ser. No. 834,597, filed Feb. 28, 1986, now U.S. Pat. No. 4,810,185.

BACKGROUND OF THE INVENTION

1. Field of the Invention

This invention relates to a fire-extinguishing device for an oil burner, and more particularly to a fire-extinguishing device used for an open-type oil burner which is adapted to discharge combustion gas or exhaust gas to the interior of a room.

2. Description of the Prior Art

Recently, an open-type oil burner has been improved in combustion performance to a degree sufficient to prevent the discharge of bad odor to the interior of a room during the combustion operation. However, the oil burner still fails to prevent the discharge of bad odor at the fire-extinguishing in spite of much effort, because combustion gas containing unburned fuel oil gas causing bad odor is discharged from a combustion cylinder construction to a room at the fire-extinguishing.

SUMMARY OF THE INVENTION

The present invention has been made in view of the foregoing disadvantage of the prior art.

Accordingly, it is an object of the present invention to provide a fire-extinguishing device for an open-type oil burner which is capable of substantially preventing the discharge of bad odor from the oil burner to the interior of a room at the fire-extinguishing of the oil burner.

It is another object of the present invention to provide a fire-extinguishing device for an open-type oil burner which is capable of accomplishing the prevention of discharge of bad odor to a room with a simple construction.

It is a further object of the present invention to provide a fire-extinguishing device for an open-type oil burner which is capable of being used in combination with a mechanism for preventing the generation of bad odor, to thereby completely prevent the discharge of bad odor from the oil burner to a room.

It is a still further object of the present invention to provide a fire-extinguishing device for an open-type oil burner which is capable of discharging combustion gas free of unburned fuel oil gas causing bad odor to a room at the fire-extinguishing of the oil burner.

It is still another object of the present invention to provide an open-type oil burner which is capable of preventing the discharge of bad odor to a room at the fire-extinguishing.

It is yet another object of the present invention to provide an open-type oil burner which is capable of sucking up therein combustion gas containing unburned fuel oil gas remaining in a combustion cylinder construction and deodorizing and discharging the remaining combustion gas at the fire-extinguishing to prevent the discharge of bad odor to a room.

Briefly speaking, a fire-extinguishing device according to the present invention is used for an open-type oil burner which is adapted to discharge combustion gas through an opening formed at an upper portion of a combustion cylinder construction to the interior of a room. The fire-extinguishing device comprises a damper arranged with respect to the opening of the combustion cylinder construction to close the opening at the fire-extinguishing of said oil burner.

In a preferred embodiment of the present invention, an oxidation catalyst plate is carried on the damper to be positioned above said opening, the oxidation catalyst plate constituting a part of said damper.

In accordance with another aspect of the present invention, there is also provided an open-type oil burner comprising a wick operating mechanism for vertically moving a wick; a combustion cylinder construction having an opening provided at an upper end thereof to discharge combustion gas therethrough to the interior of a room; a damper vertically moved in relation to the actuation of the wick operating mechanism to close the opening at the fire-extinguishing; and an oxidation catalyst plate carried on the damper to discharge combustion gas therethrough to the room at the fire-extinguishing.

In accordance with the present invention there is also provided an open-type oil burner comprising a wick operating mechanism for vertically moving a wick; a combustion cylinder construction having an opening provided at an upper end thereof to discharge combustion gas therethrough to the interior of a room; a damper vertically moved in relation to the actuation of the wick operating mechanism to close the opening at the fire-extinguishing; an oxidation catalyst plate carried on the damper to discharge combustion gas therethrough to a room at the fire-extinguishing; and a suction system for sucking up therein at least a part of combustion gas containing unburned fuel oil gas remaining in the combustion cylinder construction at the fire-extinguishing, the suction system comprising a airtightly sealed tank arranged to be exposed to combustion heat from the combustion cylinder construction and communicated with the combustion cylinder construction.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a fire-extinguishing device for an open-type oil burner according to the present invention will be described hereinafter with reference to the drawings.

Figure 1:
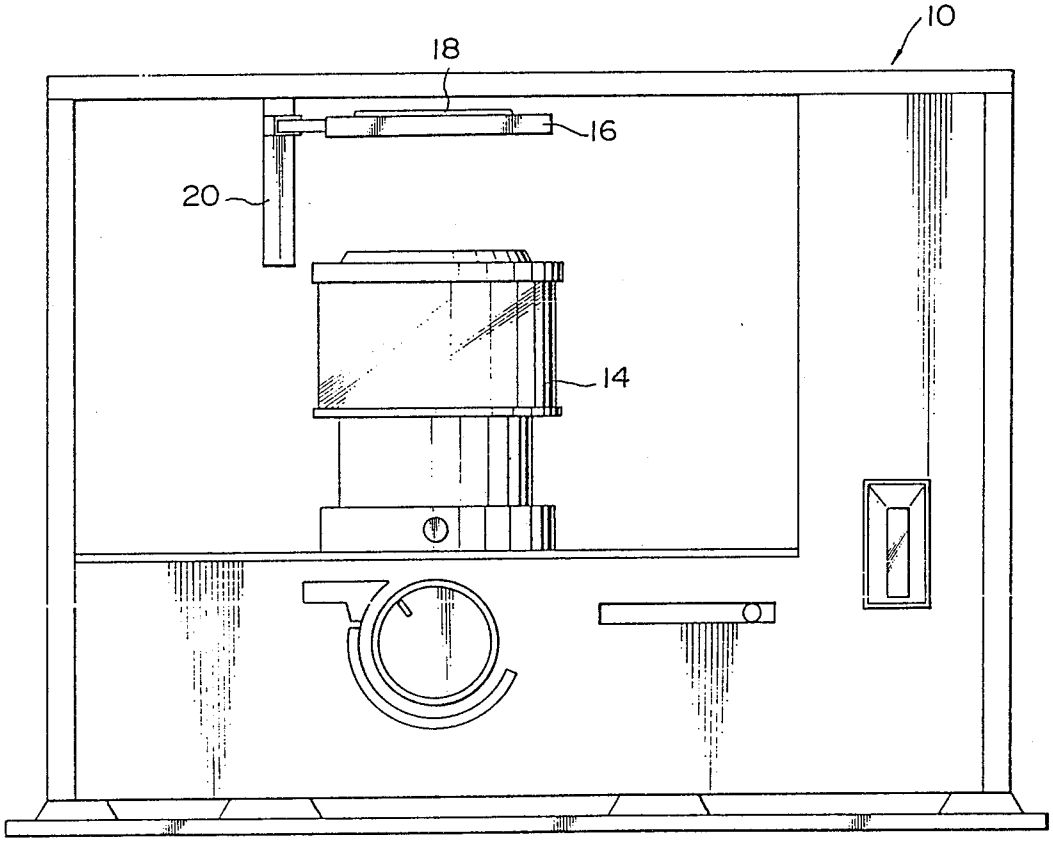
FIG. 1 is a schematic front elevation view showing an example of an open-type oil burner in which a fire-extinguishing device according to the present invention is adapted to be incorporated.

FIG. 1 illustrates an example of an open-type oil burner in which an embodiment of a fire-extinguishing device according to the present invention is adapted to be incorporated. A fire-extinguishing device of the present invention, as described above, is suitable for use for an open-type oil burner which is adapted to discharge combustion gas or exhaust gas to the interior of a room. For this purpose, an oil burner generally designated by reference numeral 10 in FIG. 1, as shown in FIG. 2, is provided with an opening 12 for discharging combustion gas to a room.

The oil burner 10 is of the wick-ignition type and includes an open type combustion cylinder construction 14 comprising multiple cylinders. The above-noted opening 12 is formed at an upper end of the combustion cylinder construction 14 to discharge combustion gas of a high temperature formed in the construction 14 therethrough to a room to assist heating of the room. However, it should be noted that an oil burner for which a fire-extinguishing device of the present invention is adapted to be used is not limited to a wick-ignition type oil burner, and the present invention can be effectively applied to a vaporization type oil burner, a pot type oil burner or the like as long as it is the open-type oil burner.

Figure 2:
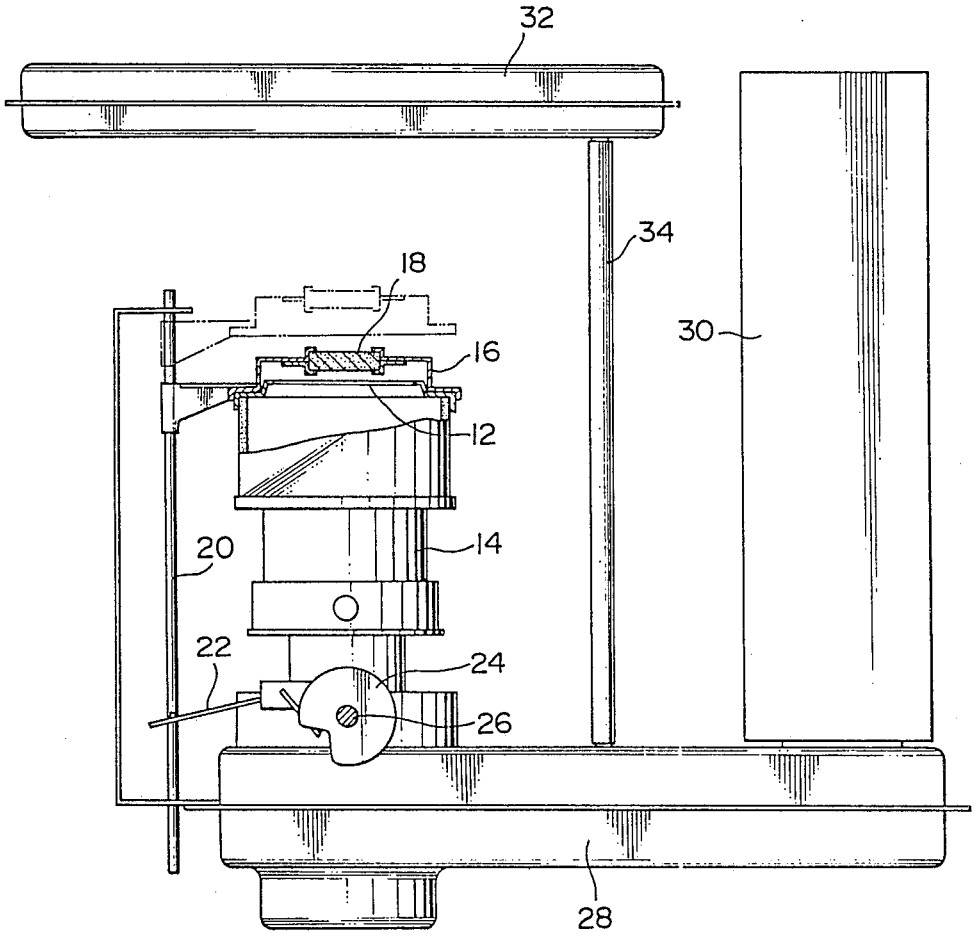
FIG. 2 is a front elevation view partly in section showing an embodiment of a fire-extinguishing device according to the present invention.

A fire-extinguishing device of the embodiment, as shown in FIG. 2, includes a shield cover or damper 16 which is arranged above the double combustion cylinder 14 of the oil burner 10 to be operated with respect to the opening 12 of the oil burner 10 in a manner to close the opening 12 at the fire-extinguishing of the oil burner 10. The damper 16 may be provided at a central portion thereof with a catalyst plate 18 which is preferably formed of an oxidation catalyst material. Alternatively, the catalyst plate 18 may be mounted on a wall of the double combustion cylinder 14 of the oil burner 10 in a manner to constitute a part of the wall. The damper 16 is supported on a damper drive shaft 20. The damper shaft 20 is connected to a pushing-up lever 22, which is then connected directly or indirectly to a cam plate 24 to be moved with the movement of the cam plate 24. The cam plate 24 is mounted on a shaft 26 for vertically moving a wick (not shown) which constitutes a part of a wick operating mechanism (not shown) of the oil burner 10. Such construction allows the damper 16 to open the opening 12 as indicated by phantom lines in FIG. 2 during the combustion operation of the oil burner wherein the wick is at its raised or combustion position, so that the discharge of combustion gas to the interior of a room during the combustion operation may be ensured. Also, at the fire-extinguishing of the oil burner, it permits the damper 16 to be moved to its lowered position through the damper drive shaft 20 to substantially close the opening 12. At the fire-extinguishing of the oil burner, it is not necessarily required to fully or sealedly close the opening 12 with the damper 16. An experiment which the inventors carried out clearly revealed that the above-noted objects of the present invention can be effectively accomplished when the damper 16 closes the opening 12 in a manner to define a small gap therebetween. Such construction has another advantage of preventing the damper 16 from striking against the combustion cylinder construction 14 to damage it at the fire-extinguishing.

Reference numeral 28 designates an oil reservoir constructed in an air-tight manner and provided at a lower portion of the oil burner 10 to receive fuel oil such as kerosene or the like therein, which is then sucked up by the wick. The oil reservoir is preferably communicated at an upper portion thereof with the combustion cylinder construction 14. Rested on the oil reservoir 28 is a cartridge-type oil storage tank 30 which is communicated with the oil reservoir 28 to feed fuel oil thereto.

Now, the manner of operation of the fire-extinguishing device of the illustrated embodiment will be described hereinafter with reference to the drawings.

As described above, the fire-extinguishing device of the illustrated embodiment is adapted to close the opening 12 for discharging combustion gas to a room with the damper 16 simultaneously with the fire-extinguishing operation. Although this causes a large amount of unburned fuel oil gas which has been prevented from being discharged through the opening 12 to flow backward through an air passage through which combustion air is fed from the exterior of the oil burner 10 to the combustion cylinder construction 14, the combustion air cools the air passage to a lower temperature sufficient to cause the fuel oil gas to be substantially condensed on a wall of the air passage, so that bad odor due to unburned fuel oil gas may be effectively prevented from being discharged to a room during the fire-extinguishing operation. The flow of combustion air into the air passage is indicated by arrow "A" in FIG. 2.

Also when the catalyst plate 18 of air-permeability is carried on the damper 16 or the wall of the combustion cylinder construction 14 of the fire-extinguishing device, the discharge of bad odor may be effectively prevented. The catalyst plate 18 acts as a combustion gas outlet or discharge port after the opening 12 is closed with the damper 16.

In general, as the larger the clarification capability of a catalyst plate is, the less the air-permeable power thereof is. Also, when a catalyst plate is exposed to a high temperature for a long period of time, it is rapidly deteriorated. However, in the illustrated embodiment, the catalyst plate 18 is carried on the damper 16 movably arranged to open and close the opening 12 or mounted on the wall of the combustion cylinder construction 14. Accordingly, combustion gas does not substantially pass through the catalyst plate 18 during the combustion operation of the oil burner because the opening 12 is opened, so that the catalyst plate 18 may not be substantially exposed to a high temperature. Also, as described above, during the combustion operation, combustion gas is discharged not through the catalyst plate 18 but from the opening 12 through a gap between the opening 12 and the damper 16 smoothly, thus, the catalyst plate 18 does not hinder the discharge of combustion gas during the combustion operation.

Further, the catalyst plate 18 of the damper 16 closes the opening 12 when the fire-extinguishing operation is carried out, resulting in combustion gas mixed with unburned fuel oil gas being discharged through the catalyst plate 18. The combustion cylinder construction 14 immediately after the fire-extinguishing of the oil burner is still maintained at a high temperature, so that the combustion gas may pass through the catalyst plate 18 while being kept at a high temperature. This permits the catalyst plate 18 to exhibit high clarification capability to a degree sufficient to deodorize the combustion gas. Also, the provision of the catalyst plate 18 prevents the back-flow of combustion gas through the above-described air passage, because the catalyst plate serves as a combustion gas outlet after the opening is closed with the damper 16.

Conventionally, the prevention of generation of bad odor at the fire-extinguishing has been carried out according to various systems. One uses a catalyst plate.

Another system is adapted to provide an air chamber around a wick to diffuse bad odor generated at the fire-extinguishing into the air chamber, to thereby prevent it from being discharged through a combustion cylinder construction to the interior of a room. A further system is called a suction system which is adapted to transfer combustion gas in a combustion cylinder construction to another place by means of a sucking-up means.

An oil burner in which the fire-extinguishing device of the illustrated embodiment is to be incorporated may employ any one of such systems for preventing the generation of bad odor together with the fire-extinguishing device of the present invention.

For example, the oil burner 10 shown in FIG. 1 employs the suction system as shown in FIG. 2. More particularly, the suction system includes an air-tightly sealed tank 32 arranged at a position sufficient to cause the tank 32 to be exposed to combustion heat generated from the combustion cylinder construction 14. The air-tight tank 32 is communicated through a connection pipe 34 with a space (not shown) defined at an upper portion of the oil reservoir above a level of oil received therein and then communicated through the space of the oil reservoir 28 to the interior of the combustion cylinder construction 14. The suction system of such construction permits at least a part of combustion gas containing unburned fuel oil gas remaining in the combustion cylinder construction 14 at the fire-extinguishing to be sucked up to the sealed tank 32 through the connected pipe 34 when the tank 32 is cooled due to the fire-extinguishing, because the volume of gas in the tank 32 is contracted due to temperature drop therein. The remaining combustion gas in the combustion cylinder construction 14 is discharged through the catalyst plate 18.

Thus, when an oil burner uses such a suction system together with the fire-extinguishing device of the present invention, bad odor can be fully prevented from being discharged to a room.

Figure 3A:
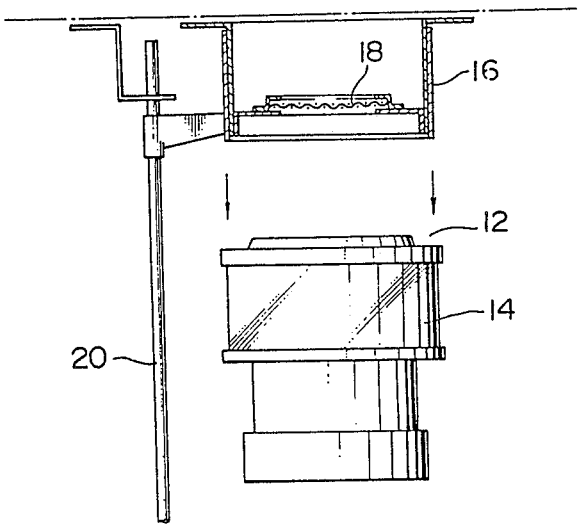
FIG. 3A is a front elevation view showing another embodiment of a fire-extinguishing device according to the present invention.
Figure 3B:
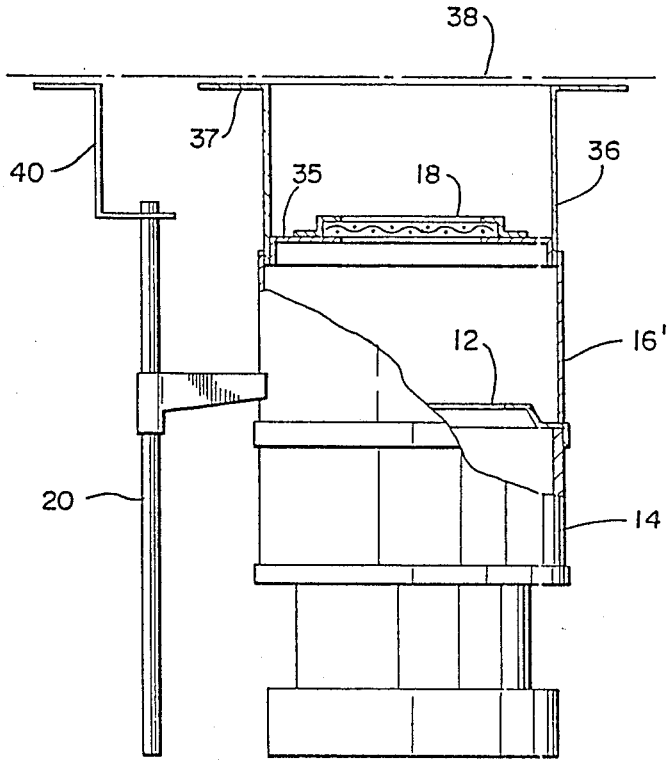
FIG. 3B is a front elevational view showing the same embodiment as FIG. 3A, but with the damper member in its closed position.

FIGS. 3A and 3B shows another embodiment of a fire-extinguishing device according to the present invention. In the embodiment of FIGS. 3A and 3B, a damper comprises a cylindrical member 16 and a shield plate 35 of an annular shape arranged in a cylindrical support 36 having an upper flange 37. A catalyst plate 18 is arranged in a central opening of the shield plate. Upper flange 37 of cylindrical support 36 and an upper bracket 40 for guiding the upper end of the damper drive shaft 20 are suspendedly fixed on a frame member of the oil burner, which is represented diagrammatically by the broken line 38. Cylindrical damper member 16' is movable received around cylindrical support 36 and is vertically movable by the damper shaft 20. During combustion operation of the oil burner, cylindrical damper member 16' is in its uppermost position as shown in FIG. 3A, whereas when fire-extinguishing is carried out, cylindrical damper member 16' is moved downwardly to cover the opening 12, while cylindrical support 36, shield plate 35 and catalyst plate 18 remain stationary as shown in FIG. 3B. The remaining part of the embodiment shown in FIGS. 3A and 3B is constructed in substantially the same manner as that of FIG. 2.

As can be seen from the foregoing, the fire-extinguishing device of the present invention effectively prevents the discharge of unburned fuel oil gas to a room, to thereby prevent the discharge of bad odor due to the unburned fuel oil gas during the fire-extinguishing operation. Also, the fire-extinguishing device of the present invention can be used together with such a mechanism for preventing the generation of bad odor as described above, resulting in the discharge of bad odor being more effectively prevented.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A fire-extinguishing device for an open-type oil burner which is adapted to discharge combustion gas generated in a combustion cylinder construction from an opening provided at a part of an outer wall of the combustion cylinder construction to the interior of a room, comprising:

a wick operating mechanism for raising and lowering a wick which supplies fuel oil being burned in said combustion cylinder construction, movement of said wick operating mechanism to a fire-extinguishing position causing said wick to be lowered into a wick receiving chamber such that a bad odor is generated in said combustion cylinder construction, and said combustion cylinder construction defining a combustion gas chamber having an internal volume substantially larger than said wick receiving chamber;

damper means arranged with respect to said opening of said combustion cylinder construction to substantially close said opening at the fire-extinguishing of said oil burner;

connecting means for connecting said damper means to said wick operating mechanism of said oil burner such that movement of said wick operating mechanism to said fire-extinguishing position causes said damper means to be actuated through said connecting means to substantially close said opening of said combustion cylinder construction such that said bad odor is substantially prevented from being discharged from said oil burner to the interior of said room at the fire-extinguishing of said oil burner.

2. A fire-extinguishing device as defined in claim 1, wherein said damper is vertically moved in relation to the movement of a wick operating mechanism of said oil burner.

3. A fire-extinguishing device as defined in claim 1, wherein said damper fully closes said opening at the fire-extinguishing.

4. A fire-extinguishing device as defined in claim 1, wherein said damper closes said opening in a manner to define a small gap between said damper and said opening.

5. A fire-extinguishing device as defined in claim 1, wherein said damper includes as a part thereof an oxidation catalyst plate.

6. A fire-extinguishing device as defined in claim 1 further comprising an oxidation catalyst plate mounted on a movable part of a wall of said combustion cylinder construction.

7. A fire-extinguishing device as defined in claim 1, further comprising a deodorizing means for removing said bad odor from combustion gas discharged from said combustion cylinder construction, said substantial closure of said opening of said combustion cylinder construction by said damper means causing combustion gas containing unburned fuel oil gas to pass into said deodorizing means.

8. A fire-extinguishing device as defined in claim 7, wherein said deodorizing means comprises an air-permeable oxidation catalyst plate for removing said bad odor from combustion gas passing therethrough.

9. A fire-extinguishing device as defined in claim 7, wherein said damper means has an open position spaced from said opening when said wick operating mechanism is in an oil burning position, and said deodorizing means comprises an air passage through which combustion air is fed from the exterior of the oil burner to said combustion cylinder construction when said damper means is in said open position, said substantial closure of said opening by said damper means causing combustion gas from said combustion cylinder construction to flow backward through said air passage, and the quantity of combustion air fed through said air passage when said damper means is in said open position being sufficient to keep a wall of said air passage sufficiently cool to cause unburned fuel oil gas in said backward flow of combustion gas to be condensed on said wall.

10. A fire-extinguishing device as defined in claim 1, wherein said damper means is moved vertically in response to the raising and lowering of said wick by said wick operating mechanism.

11. A fire-extinguishing device as defined in claim 1, wherein said damper means comprises shield means arranged above said combustion cylinder construction, a cylindrical damper member vertically movable between said shield means and said combustion cylinder construction, and an air permeable oxidation catalyst plate mounted on said shield means.

12. A fire-extinguishing device as defined in claim 11, wherein said shield means comprises a shield plate fixed to a frame member of said oil burner, and wherein said catalyst plate is arranged in an opening of said shield plate.

13. A fire-extinguishing device as defined in claim 1 further comprising a suction system for sucking up therein at least a part of combustion gas containing unburned fuel oil gas remaining in said combustion cylinder construction at the fire-extinguishing, said suction system comprising an air-tightly sealed tank arranged to be exposed to combustion heat from said combustion cylinder construction and communicated with said combustion cylinder construction.

14. An open-type oil burner comprising:

a wick operating mechanism for raising and lowering a wick relative to a wick receiving chamber;

a damper means vertically movable in relation to said opening to substantially close said opening at the fire-extinguishing;

a suction system for sucking up therein at least a part of combustion gas containing unburned fuel oil gas remaining in said combustion cylinder construction at the fire-extinguishing, said suction system comprising an air-tightly sealed tank arranged to be exposed to combustion heat from said combustion cylinder construction and communicated with said combustion cylinder construction, and said lowering of the wick causing cooling of said air-tightly sealed tank; and connecting means for connecting said damper means to said wick operating mechanism of said oil burner such that movement of said wick operating mechanism to said fire-extinguishing position causes said damper means to be actuated through said connecting means to substantially close said opening, said substantial closure of said opening and said cooling of said air-tightly sealed tank substantially preventing said bad odor from being discharged from said oil burner to the interior of said room at the fire-extinguishing of said oil burner.

15. A fire-extinguishing device for an open-type oil burner which is adapted to discharge combustion gas from an opening provided at a first fixed wall portion of a combustion cylinder construction to the interior of a room, comprising:

damper means arranged with respect to said opening of said combustion cylinder construction to substantially close said opening at the fire-extinguishing of said oil burner, said damper means comprising a vertically movable wall portion of said combustion cylinder construction and an oxidation catalyst plate mounted on a second fixed wall portion of said combustion cylinder construction, said second fixed wall portion being suspended above said first fixed wall portion by a frame means of said oil burner; and, means for connecting said vertically movable wall portion to a wick operating mechanism of said oil burner such that movement of said wick operating mechanism to a fire-extinguishing position causes said damper means to substantially close said opening and said wick to be lowered such that a bad odor is generated in said combustion cylinder construction, said substantial closure of said opening substantially preventing said bad odor from being discharged from said oil burner to the interior of said room at the fire-extinguishing of said oil burner.

16. A fire-extinguishing device for an open-type oil burner which is adapted to discharge combustion gas through an opening provided at an upper portion of a combustion cylinder construction to the interior of a room, comprising:

a cylindrical damper for substantially closing said opening of said combustion cylinder construction at the fire-extinguishing of said oil burner;

an oxidation catalyst plate arranged above said combustion cylinder construction, said oxidation catalyst plate constituting a part of a top plate of said combustion cylinder construction suspended on a frame member of the oil burner; and means for connecting said damper to a wick operating mechanism of said oil burner such that movement of said wick operating mechanism to a fire-extinguishing position causes said damper to substantially close said opening and said wick to be lowered into a wick receiving chamber such that a bad odor is generated in said combustion cylinder construction, said substantial closure of said opening substantially preventing said bad odor from being discharged from said oil burner to the interior of said room at the fire-extinguishing of said oil burner.

* * * * *